US011703251B2

(12) United States Patent
kelly et al.

(10) Patent No.: US 11,703,251 B2
(45) Date of Patent: Jul. 18, 2023

(54) FABRIC COVER WITH AIR PERMEABLE PANELS

(71) Applicants: Robert Scott kelly, Inver Grove Heights, MN (US); Kenneth James Schultz, Carver, MN (US)

(72) Inventors: Robert Scott kelly, Inver Grove Heights, MN (US); Kenneth James Schultz, Carver, MN (US)

(73) Assignee: Robert Scott Kelly, Carver, MN (US)

( * ) Notice: Subject to any disclaimer, the term of this patent is extended or adjusted under 35 U.S.C. 154(b) by 0 days.

(21) Appl. No.: 17/670,797

(22) Filed: Feb. 14, 2022

(65) Prior Publication Data

US 2022/0163231 A1 May 26, 2022

Related U.S. Application Data

(63) Continuation of application No. 16/670,489, filed on Oct. 31, 2019, now abandoned.

(60) Provisional application No. 62/753,206, filed on Oct. 31, 2018.

(51) Int. Cl.
*F24F 13/20* (2006.01)
*F24F 13/00* (2006.01)

(52) U.S. Cl.
CPC ..... *F24F 13/20* (2013.01); *F24F 2013/202* (2013.01)

(58) Field of Classification Search
CPC ..... F24F 13/20; F24F 1/58; F24F 2013/202
USPC ..... 52/3
See application file for complete search history.

(56) References Cited

U.S. PATENT DOCUMENTS

| | | | | |
|---|---|---|---|---|
| 39,954 A * | 9/1863 | Powell | A47C 17/64 5/113 |
| 691,318 A * | 1/1902 | Martin | A01F 25/16 52/3 |
| 1,409,609 A | 3/1922 | Stockle | |
| 1,820,104 A | 8/1931 | Whaley | |
| 1,871,570 A * | 8/1932 | Weber | B63B 19/12 160/370.21 |
| 2,420,706 A * | 5/1947 | Haven | E04H 1/1238 135/97 |

(Continued)

FOREIGN PATENT DOCUMENTS

| | | | |
|---|---|---|---|
| CA | 2977728 A1 * | 2/2018 | E04H 15/001 |
| EP | 2767768 A1 * | 8/2014 | F24F 1/58 |

(Continued)

OTHER PUBLICATIONS

"Cabaret Stretch Mesh with Large Holes", https://www.fabricwholesaledirect.com/products/cabaret-stretch-mesh-fabric?variant=39460376510579, Feb. 26, 2016, 3 pages.

*Primary Examiner* — Brian D Mattei
*Assistant Examiner* — Joseph J. Sadlon
(74) *Attorney, Agent, or Firm* — Billion & Armitage

(57) ABSTRACT

Embodiments of the present disclosure describe fabric covers, such as those used for air conditioning units, having a first air permeable panel for covering a horizontal top panel of an air conditioner unit; a second air permeable panel extending downward from the first air permeable panel for covering vertical side panels of the air conditioner unit; and an adjustable fastener provided in a bottom portion of the second air permeable panel for securing the cover to a base of the air conditioner unit.

16 Claims, 9 Drawing Sheets

(56) References Cited

U.S. PATENT DOCUMENTS 2,666,840 A * 1/1954 Poirier ..... H05B 3/342 219/535
2,705,990 A 4/1955 Miller
2,711,769 A 6/1955 Katcher et al.
2,901,989 A 9/1959 Mondi
2,985,447 A * 5/1961 Braskamp ..... F24F 13/1426 292/264
3,288,506 A 11/1966 Cline
3,320,996 A 5/1967 Isadore
3,785,451 A * 1/1974 McCord ..... B32B 27/12 180/69.1
4,019,556 A 4/1977 Selger
4,308,905 A 1/1982 Gallagher
4,340,115 A * 7/1982 Wright ..... F24F 1/50 165/125
4,475,585 A 10/1984 Hoeffken
4,498,912 A 2/1985 Wagner
4,538,385 A * 9/1985 Kandarian ..... A01F 25/13 206/83.5
4,653,385 A 3/1987 Ito et al.
4,682,436 A 7/1987 Ritson
4,749,390 A 6/1988 Burnett et al.
4,785,136 A 11/1988 Mollet et al.
4,787,366 A * 11/1988 Bell ..... F24B 1/198 5/493
4,811,767 A 3/1989 Kessler
4,815,530 A * 3/1989 Scott ..... F24F 13/20 62/507
4,819,389 A 4/1989 Kihn
4,877,106 A 10/1989 Neville et al.
4,891,918 A * 1/1990 Wiley ..... B65D 85/62 47/20.1
4,947,794 A 8/1990 Baldwin
4,961,981 A * 10/1990 Keegan ..... B60J 11/00 428/72
5,097,678 A * 3/1992 Aubuchon ..... F24F 1/58 62/506
5,156,662 A 10/1992 Downing et al.
5,158,486 A 10/1992 Tamame
5,183,435 A * 2/1993 Galvez ..... F24F 7/02 454/30
5,184,475 A 2/1993 Matsumi
5,230,798 A 7/1993 Rogman
5,234,582 A 8/1993 Savoie
5,240,756 A * 8/1993 Finell ..... B60P 7/04 428/45
5,307,849 A 5/1994 Nelson
5,520,003 A 5/1996 Cornfield
5,529,593 A 6/1996 Simmons
5,545,844 A 8/1996 Plummer et al.
5,606,986 A 3/1997 Muise
5,782,689 A 7/1998 Woolsey et al.
5,788,849 A 8/1998 Hutter et al.
5,809,800 A 9/1998 Deal
5,971,505 A 10/1999 Zamora
6,045,329 A 4/2000 Sobala
6,139,426 A 10/2000 Koerber
6,158,175 A 12/2000 Carter
6,221,120 B1 4/2001 Bennington et al.
6,350,000 B1 * 2/2002 Van Benthem ..... E04H 1/1238 312/236
6,397,617 B1 * 6/2002 Johnson ..... F24F 1/58 49/465
6,401,474 B1 * 6/2002 Wigglesworth ..... F24F 13/082 62/507
6,430,954 B1 8/2002 Smith
6,447,389 B1 9/2002 Kuo
6,497,463 B2 12/2002 Moretti
6,595,017 B1 * 7/2003 Teahan ..... F24F 1/50 62/DIG. 13
6,708,514 B1 3/2004 Miller
6,933,251 B2 * 8/2005 Kikuchi ..... B29C 66/729 428/125
7,032,402 B2 4/2006 Braswell
7,044,083 B2 5/2006 Farmer et al.
7,100,395 B2 9/2006 Kim et al.
7,127,908 B2 10/2006 Flaugher et al.
7,140,194 B1 11/2006 Miller
7,156,987 B1 1/2007 Sanguinetti
7,246,468 B2 7/2007 Forbis et al.
7,357,219 B2 * 4/2008 Mafi ..... F24F 1/12 181/290
D572,517 S 7/2008 Lerma et al.
7,461,485 B2 * 12/2008 Toledo ..... E04H 15/008 135/114
7,523,719 B2 4/2009 Miller et al.
7,540,392 B2 6/2009 Cipra et al.
7,547,341 B2 * 6/2009 Sandberg ..... B01D 46/0005 55/491
7,819,151 B1 * 10/2010 Kuhn ..... B65F 1/1426 428/17
7,823,340 B2 11/2010 Dejonge et al.
7,856,833 B2 * 12/2010 Young ..... F24F 1/58 62/298
D634,413 S 3/2011 Wallace
8,266,916 B2 9/2012 Dillon
8,357,031 B2 1/2013 Dinicolas
8,418,402 B2 4/2013 Rasmussen
8,454,720 B1 6/2013 Bond
8,505,182 B2 8/2013 Kuhn
8,510,998 B1 8/2013 Martinez
D689,157 S 9/2013 Lucero
D704,812 S 5/2014 Benjamin
8,746,790 B2 6/2014 Beaty Bishop
8,783,309 B2 7/2014 Betlem
8,826,927 B1 9/2014 Beam et al.
8,950,208 B2 2/2015 Bae et al.
8,984,815 B1 * 3/2015 LaFour ..... E04G 21/28 52/506.04
9,023,456 B2 5/2015 Flansburg et al.
9,061,342 B2 6/2015 Hermanson
9,091,455 B1 * 7/2015 Coster ..... F24F 13/20
9,194,630 B2 11/2015 Mariotto et al.
9,271,571 B2 * 3/2016 DeLorean ..... A47B 46/005
9,976,759 B2 * 5/2018 Eskew ..... F24F 1/22
10,081,038 B2 9/2018 Steinmann
10,174,956 B2 * 1/2019 Stanton ..... F24F 1/58
10,279,300 B2 * 5/2019 Nelson ..... B01D 46/525
10,352,574 B2 7/2019 Hamlin et al.
10,925,990 B2 2/2021 Rataj
2007/0011930 A1 1/2007 Yarmosh
2007/0204945 A1 9/2007 Ross
2008/0083239 A1 4/2008 Meyer
2011/0201265 A1 8/2011 Messinger et al.
2013/0174882 A1 7/2013 Ellenbecker
2014/0194053 A1 7/2014 Carroll
2015/0034255 A1 2/2015 Dendulk et al.
2016/0054012 A1 2/2016 Lepoudre et al.
2016/0061483 A1 3/2016 Delano
2017/0291710 A1 10/2017 Barr-Perea et al.

FOREIGN PATENT DOCUMENTS

GB 905113 A 9/1962
JP 2018091612 A 6/2018

* cited by examiner

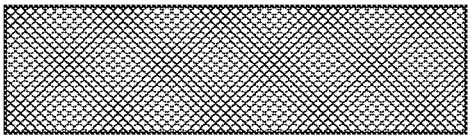
FIG. 8B
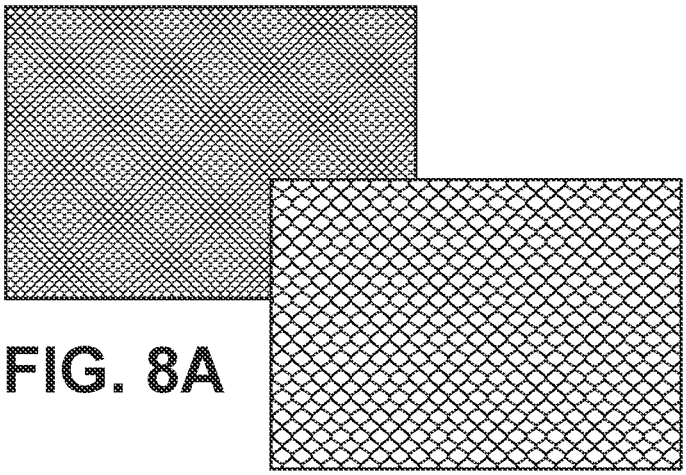
FIG. 8A
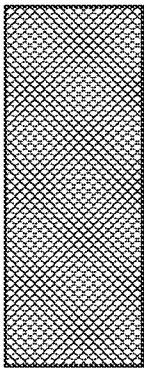
FIG. 8C
FIG. 8D

FABRIC COVER WITH AIR PERMEABLE PANELS

CROSS-REFERENCE TO RELATED APPLICATION

This application is a continuation application and claims the benefit of co-pending U.S. patent application Ser. No. 16/670,489, filed Oct. 31, 2019, which claimed the benefit of U.S. Provisional Patent Application No. 62/753,206, filed Oct. 31, 2018, the entire disclosure of each of which is hereby incorporated herein by reference.

BACKGROUND

Air conditioner units are typically exposed to elements from indoor and/or outdoor environments that can cause damage or impair operation of the units. Conventional covers are available, but they are designed to completely enclose the air conditioner unit, without allowing any air flow into or out of the air conditioner unit. As air flow is required to release cooled air and discharge heat, such covers thus reduce the efficiency of the air conditioner unit during normal operation and can even entirely prevent the air conditioner from operating. Accordingly, it would be desirable to provide a cover for air conditioner units that is capable of serving as a protective element, without diminishing the performance and/or operation of the air conditioner unit.

SUMMARY

In general, embodiments of the present disclosure describe covers for air conditioner units and the like.

Embodiments of the present disclosure describe a cover for an air conditioner unit comprising a first air permeable panel for covering a horizontal top panel of an air conditioner unit; a second air permeable panel extending downward from the first air permeable panel for covering vertical side panels of the air conditioner unit; and an adjustable fastener provided in a bottom portion of the second air permeable panel for securing the cover to a base of the air conditioner unit.

Embodiments of the present disclosure further describe a cover for an air conditioner window unit comprising a first air permeable panel for covering a horizontal top panel of an air conditioner unit, wherein the first air permeable panel includes a first material; a second air permeable panel extending downward from the first air permeable panel for covering vertical side panels of the air conditioner unit, wherein the second air permeable panel includes a first section with the first material and a second section with a second material that is different from the first material; and an adjustable fastener provided in a bottom portion of the second air permeable panel for securing the cover to a base of the air conditioner unit.

The details of one or more examples are set forth in the description below. Other features, objects, and advantages will be apparent from the description and from the claims.

BRIEF DESCRIPTION OF DRAWINGS

This written disclosure describes illustrative embodiments that are non-limiting and non-exhaustive. In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

Reference is made to illustrative embodiments that are depicted in the figures, in which:

FIGS. 8A-8D are schematic drawings showing air permeable materials, with (A-C) showing a first material and (D) showing a second material, according to one or more embodiments of the present disclosure.

DETAILED DESCRIPTION

Figure 1:
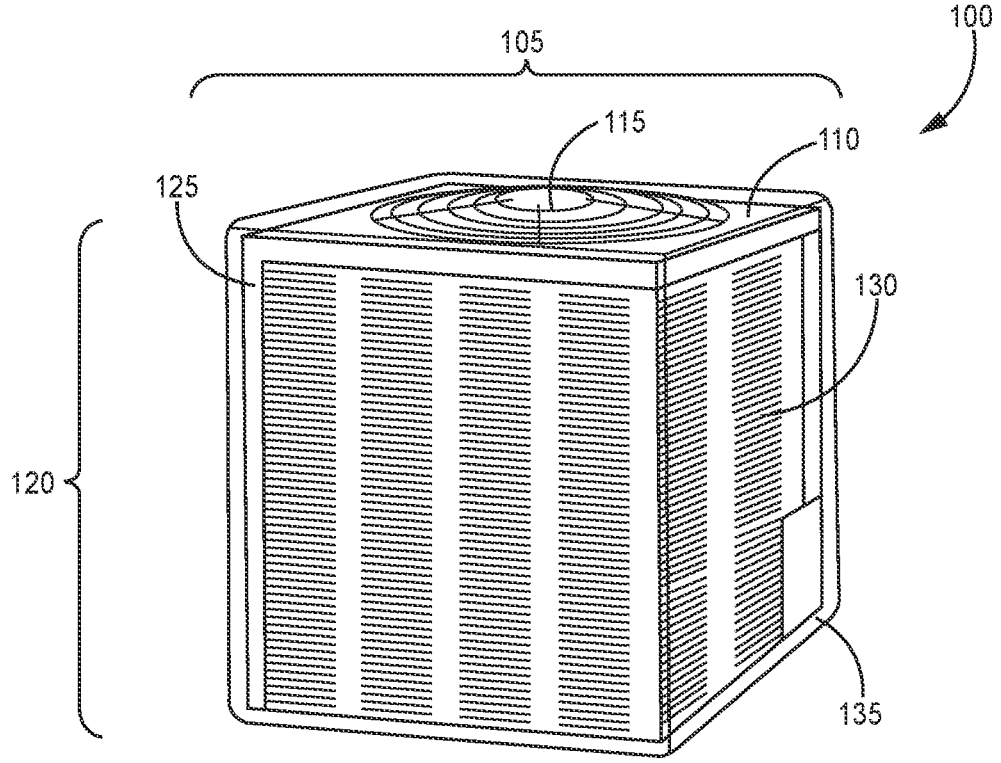
FIG. 1 PRIOR ART
FIG. 1 is a schematic drawing showing a perspective view of a conventional air conditioner unit, according to one or more embodiments of the present disclosure.

Embodiments of the present disclosure describe covers for air conditioner units comprising one or more of the following: a first air permeable panel for covering a horizontal top panel of an air conditioner unit, a second air permeable panel extending downward from the first air permeable panel for covering vertical side panels of the air conditioner unit, and an adjustable fastener for securing the cover to the air conditioner unit.

The first air permeable material and the second air permeable material can be made of the same material or different materials. For example, the first air permeable panel and the second air permeable panel can be made of the same material (e.g., a single material). Alternatively, the first air permeable panel, or a part thereof, can be made of a material that is different from a material forming the second air permeable panel, or a part thereof. In addition, the first air permeable panel can be made entirely of the same material (e.g., a single material) or it can be made of a combination of materials (e.g., two or more materials). The second air permeable panel can similarly be made entirely of the same material (e.g., a single material) or it can be made of a combination of materials (e.g., two or more materials).

Each of the first air permeable panel and the second air permeable panel can generally include one or more sections. One or more sections, for example, can be added or removed from any given cover to adapt the covers described herein to air conditioner units of various sizes, geometries, and configurations, and to achieve desired fits. The one or more sections of the first air permeable panel and the second air permeable panel can be made of the same material or different materials. The one or more sections can also generally be connected by one or more seams (not shown). The seams can be used to provide covers as continuous or substantially continuous materials. For example, embodiments of the present disclosure describe covers comprising a first air permeable panel including one or more sections connected by one or more seams and a second air permeable panel including one or more sections connected by one or more seams. The seams can be made of any suitable material. In an embodiment, the seams are made of an elastic material, a VELCRO® material, a combination thereof, or other such suitable materials.

The adjustable fastener can include any material suitable for securing the cover to the air conditioner unit. For example, the adjustable fastener can include drawstring, elastic, hooks, latches, or combinations thereof. The positioning of the adjustable fastener on the cover is not particularly limited and can be provided in any location convenient for securing the cover the air conditioner unit. For example, in an embodiment, the adjustable fastener is provided in a bottom portion of the second air permeable panel for securing the cover to a base of the air conditioner unit.

Although reference is made below to covers for certain air conditioner units, the covers of the present disclosure are not particularly limited in size, shape, configuration, and fit and thus such discussion shall not be limiting. The covers can be adapted to fit air conditioner units of a wide variety of sizes, shapes, and configurations.

A perspective view of a conventional air conditioner unit 100 is shown in FIG. 1, according to one or more embodiments of the present disclosure. As shown in FIG. 1, the conventional air conditioner unit 100 comprises a horizontal top panel 105 and one or more vertical side panels 120. The horizontal top panel 105 can include a top surface 110 with a centralized discharge grill 115 enclosing a fan (not shown). Heat generated during operation of the air conditioner unit 100 can be discharged through the grill 115. The one or more of the vertical side panels 120 can include vertical surfaces 125 with vented air intakes 130. Cooling air can be supplied through the vented air intakes 130 to the air conditioner unit 100. The air conditioner unit 100 can further comprise a base 135, which can be provided on or near a bottom portion of the air conditioner unit 100. The air conditioner unit 100 may include other elements and components known in the art. They have been omitted from the present discussion for clarity.

Figure 2:
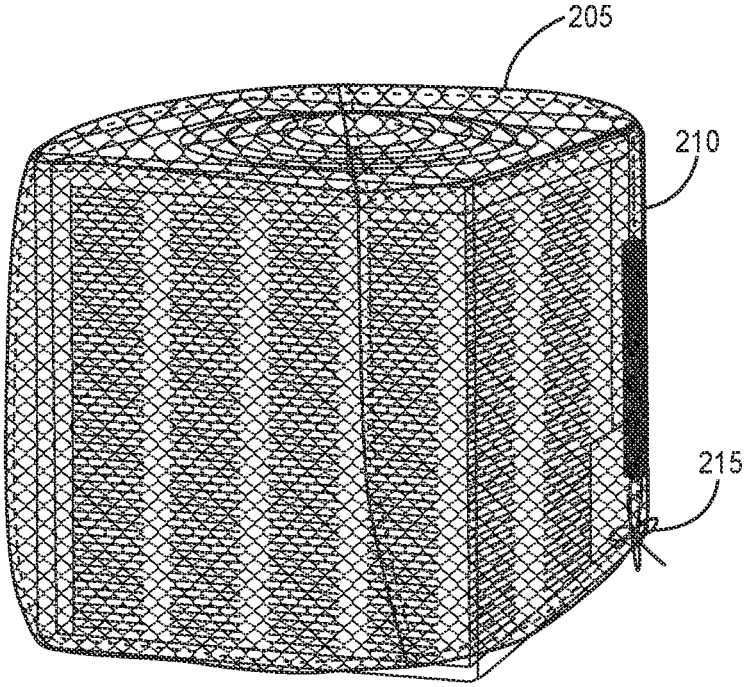
FIG. 2 is a schematic drawing showing a perspective view of a cover on an air conditioner unit, according to one or more embodiments of the present disclosure.

A perspective view of a cover 200 provided on the air conditioner unit 100 is shown in FIG. 2, according to one or more embodiments of the present disclosure. As shown in FIG. 2, the cover 200 can comprise one or more of the following: a first air permeable panel 205 for covering a horizontal top panel 105 of an air conditioner unit 100, a second air permeable panel 210 extending downward from the first air permeable panel 205 for covering vertical side panels 120 of the air conditioner unit 100, and an adjustable fastener 215 provided in a bottom portion of the second air permeable panel 210 for securing the cover to a base 135 of the air conditioner unit 100.

Figure 3:
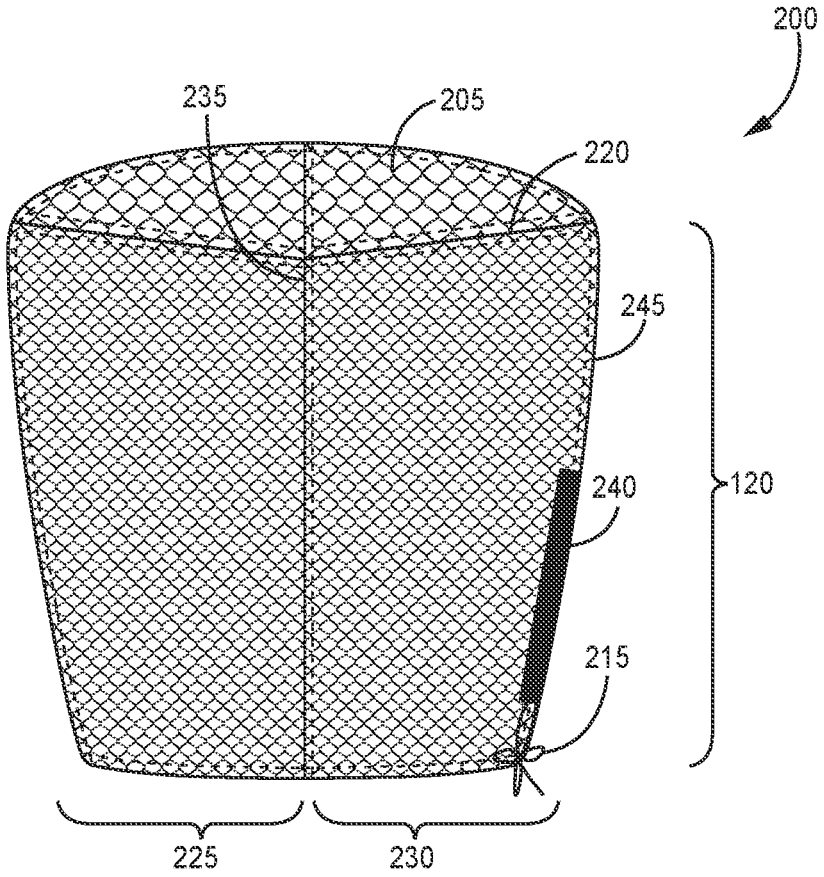
FIG. 3 is a schematic drawing showing a side view of a cover on an air conditioner unit, according to one or more embodiments of the present disclosure.

A side view of the cover 200 provided on the air conditioner unit 100 is shown in FIG. 3, according to one or more embodiments of the present disclosure. As shown in FIG. 3, the cover 200 can comprise a first air permeable panel 205 connected to the second air permeable panel 210 by seam 220. The second air permeable panel 210 can include a first section 225 and a second section 235 connected by seam 245. The adjustable fastener 215 can be provided in a bottom portion of the second air permeable panel 210 for securing the cover 200 to a base 135 of the air conditioner unit 100. An adjustable element 240, such as VELCRO®, can be provided on or near seam 245 above the adjustable fastener 215 to allow the cover 200 to be fitted and/or secured to the air conditioner unit 100.

Figure 4:
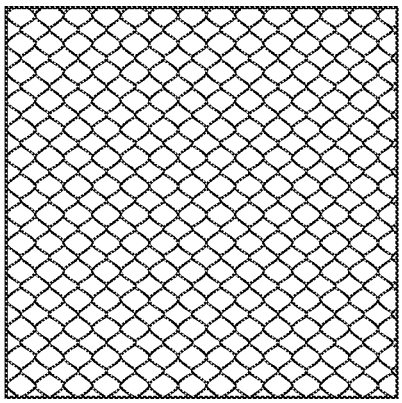
FIG. 4 is a schematic drawing of an air permeable material, according to one or more embodiments of the present disclosure.
Figure 5:
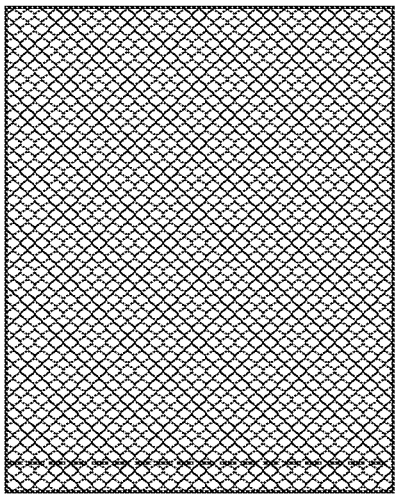
FIG. 5 is a schematic drawing of an air permeable material, according to one or more embodiments of the present disclosure.

The first air permeable panel 205 and the second air permeable panel 210 can be made of the same material or different materials. In an embodiment, the first air permeable panel 205 is made of a first material and the second air permeable panel 210 is made of a second material that is different from the first material. For example, in an embodiment, the first air permeable panel 205 can be represented by a material 400 shown in FIG. 4; and the second air permeable panel 210 can be represented by a material 500 shown in FIG. 5. The first material, second material, or both can be made of a stretchable material or fabric. In an embodiment, each of the first material and the second material can be independently selected from the group consisting of power mesh, cabaret stretch mesh, and honeycomb mesh, among other types of materials and fabrics. Alternatively, in an embodiment, the first air permeable panel 205 and the second air permeable panel 210 are made of the same material, which can include any of the first materials or second materials described herein.

The first air permeable panel 205 and the second air permeable panel 210 can be characterized by an average pore size. For example, the material—either the first material or the second material—of the first air permeable panel and/or the second air permeable panel can be selected based on an average pore size of the fabric. The average pore sizes can range from about 1 mm to about 1 cm. In an embodiment, the average pore size of the first air permeable panel is greater than an average pore size of the second air permeable panel. For example, in an embodiment, the average pore sizes of the first air permeable panel 205 and the second air permeable panel 210 are 1 cm and 1 mm, respectively.

The material of the first air permeable panel 205 and the second air permeable panel 210 can further be selected to maintain a desired flow rate of air entering and exiting the air conditioner unit. The desired flow rate of the first air permeable panel 205 can be different from, or the same as, the desired flow rate of the second air permeable panel 210. In an embodiment, a desired flow rate of the first air permeable panel is about 1300 $ft^3$ $min^{-1}$. The flow rate of either the first air permeable panel 205 or the second air permeable panel 210 is not particularly limited. Accordingly, the flow rates of either panel can be greater than or less than about 1300 $ft^3$ $min^{-1}$.

Figure 6:
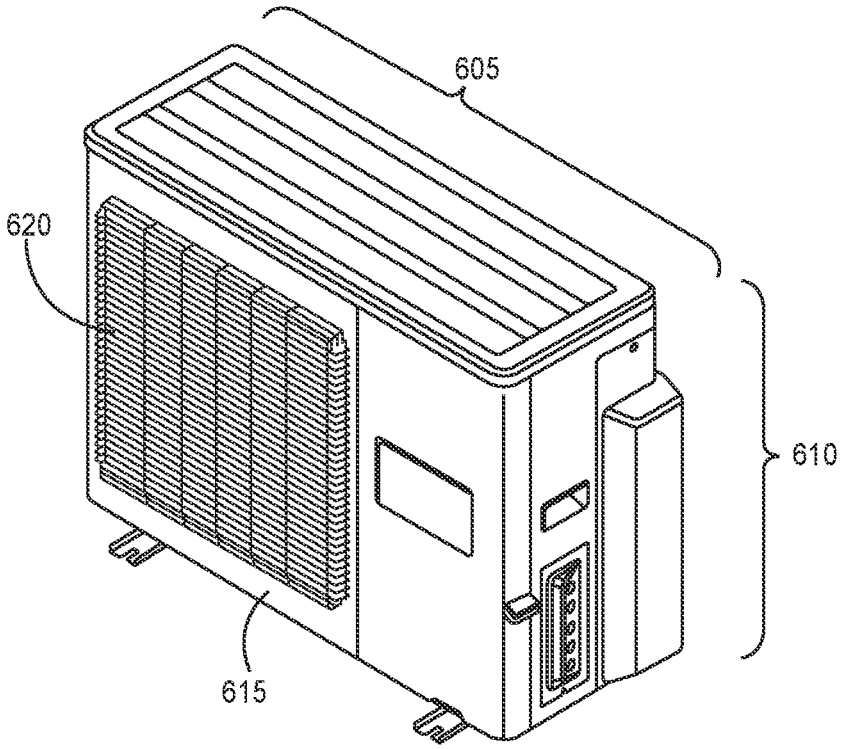
FIG. 6 is a schematic drawing showing a perspective view of a conventional air conditioner window unit, according to one or more embodiments of the present disclosure.

A perspective view of a conventional air conditioner window unit 600 is shown in FIG. 6, according to one or more embodiments of the present disclosure. As shown in FIG. 6, the conventional air conditioner window unit 600 comprises a horizontal top panel 605 and one or more vertical side panels 610. The one or more vertical side panels can include a first vertical panel 615 with vents 620 through which warm air from indoors enters the air conditioner unit 600 and cooled air exits or returns to the indoor space. The vertical side panels can include a second vertical panel 625 (not shown) with vents 630 through which heat can be discharged from the air conditioner unit 600.

Figure 7:
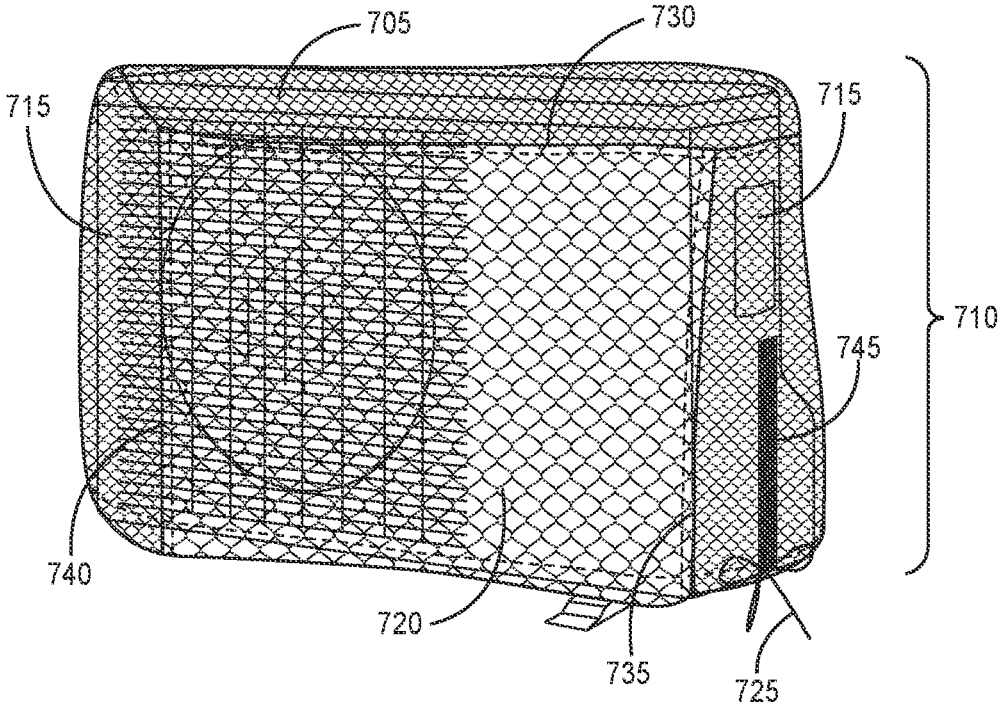
FIG. 7 is a schematic drawing showing a perspective view of a cover on an air conditioner window unit, according to one or more embodiments of the present disclosure.

A perspective view of a cover 700 provided on the air conditioner unit 700 is shown in FIG. 7, according to one or more embodiments of the present disclosure. As shown in FIG. 7, the cover 700 can comprise one or more of the following: a first air permeable panel 705 for covering a horizontal top panel 605 of an air conditioner unit 600, wherein the first air permeable panel 705 includes a first material; a second air permeable panel 710 extending downward from the first air permeable panel 705 for covering vertical side panels 610 of the air conditioner unit 600, wherein the second air permeable panel 710 includes a first section 715 including the first material and a second section 720 including a second material that is different from the first material; and an adjustable fastener 725 provided in a bottom portion of the second air permeable panel 710 for securing the cover to a base of the air conditioner unit 600.

The first air permeable panel, the second air permeable panel, any sections thereof can be connected by one or more seams. For example, in an embodiment, the first air permeable panel 705 can be connected to the second air permeable panel by seam 730; and the second section 720 of the second air permeable panel can be connected to the first section 715 of the second air permeable panel by seams 735 and 740.

The second section 720 can be provided in any suitable area of the cover 700. For example, in an embodiment, the second section 720 including the second material is provided in an area of the cover 700 that allows the second section 720 to cover the first vertical panel 615 of the air conditioner unit 600. In an embodiment, the second section 720 including the second material is further provided in an area of the cover 700 that allows the second section 720 to cover the second vertical panel 625 of the air conditioner unit 600.

The first material, second material, or both can be made of any of the materials described herein, such as stretchable fabric. In an embodiment, the first material and the second material can be selected from the group consisting of power mesh, cabaret stretch mesh, and honeycomb mesh. In an embodiment, the first material can be represented by the material shown in FIGS. 8A-8C, and the second material can be represented by the material shown in FIG. 8D.

The first material and the second material can be characterized by an average pore size and can be selected to maintain a desired flow rate of air entering and exiting the air conditioner unit. For example, in an embodiment, the second material of the second section 720 can be characterized by an average pore size that is greater than an average pore size of the first material included in the first section 715 of the second air permeable panel and the first air permeable panel 705. For example, an average pore size of the first material can be about 1 mm and an average pore size of the second material can be about 1 cm. In an embodiment, the second material can maintain an air flow of about 1300 $ft^3$ $min^{-1}$.

The adjustable fastener 725 can be provided in a bottom portion of the second air permeable panel 710 for securing the cover 700 to the air conditioner unit 600. The adjustable fastener 725 can include any of the materials described herein. For example, in an embodiment, the adjustable fastener is elastic or a drawstring. An adjustable element 745, such as VELCRO®, can be provided above the adjustable fastener 725 to allow the cover 700 to be fitted and/or secured to the air conditioner unit 600.

Figure 9:
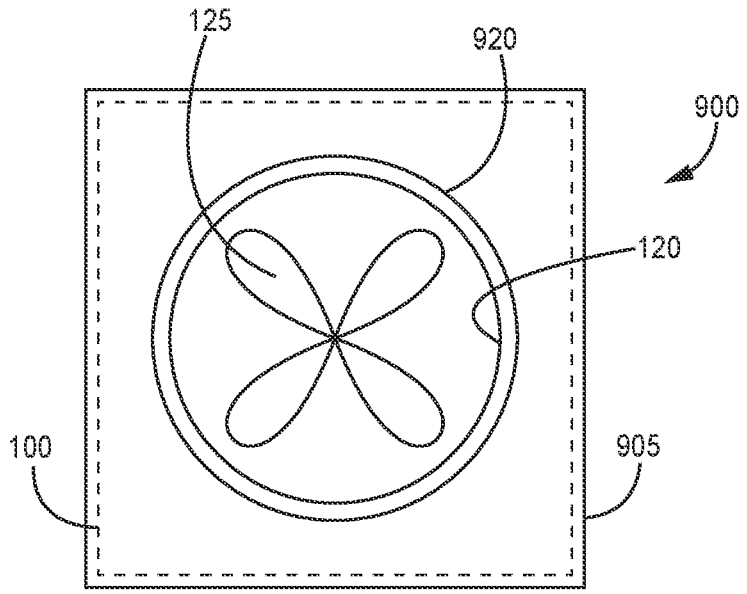
FIG. 9 is a top view of an air permeable material, according to one or more embodiments of the present disclosure.

FIG. 9 is top view of another embodiment if a cover 900 provided for an air conditioning unit, such as air conditioner unit 100 is shown in FIG. 1, according to another example embodiment. As shown in FIG. 9, a first air permeable panel 905 for covering the horizontal top panel 105 of an air conditioner unit 100 (shown in FIG. 1) is shown. The first air permeable panel 905 is made of a substantially non stretch fabric such as canvas or CORDURA® nylon. The fabric is durable. In some embodiments, corners can be fashioned with the non-stretch or low stretch fabric which correspond to the corners of the top panel 105 of the air conditioner unit 100 (shown in FIG. 1). The corners so fashioned will fit over the corners of the top panel 105 to hold it in place. In other embodiments, the first air permeable panel can be provided with other means for attaching to the horizontal panel 105. For example, straps could be placed at the corners designed and dimensioned to attach to the corners of the horizontal top panel of the air conditioner unit 100. The first air permeable panel 905 has an exhaust opening 920 therein. The exhaust opening 920 allows for a cover that will not substantially interfere with the flow from an exhaust port 120 of the air conditioner unit 100. As shown in FIG. 9, an air handler 125 is positioned near the exhaust port 120 to draw air through the heat exchange fins of the air conditioner and out the exhaust port 120. The opening 920 in the first air permeable panel 905 for covering the horizontal top panel 105 is equal to or greater than the opening of the exhaust port 120 of the air conditioner unit 100. As shown in FIG. 9, the opening 920 is completely open. It should be understood that there may be some structure that crosses the opening, such as a wire, that helps to maintain the shape of the opening 920 in the panel 905. In these embodiments, the idea is to keep the opening 120 in the air conditioning unit substantially open to allow for maximum or the designed amount of airflow out the exhaust port so the maximum heat can be removed from the fluid in the refrigeration cycle. In other embodiments, the opening 920 may include a hoop of structural material. The second air permeable panel 210 or panels extends downward from the first air permeable panel 905 for covering vertical side panels 120 of the air conditioner unit 100, and an adjustable fastener 215 provided in a bottom portion of the second air permeable panel 210 for securing the cover to a base 135 of the air conditioner unit 100. It should be noted that the second air permeable panels can be provided with various sizes of mesh to prevent various problems. For example, in some environments, the "cotton" from a cottonwood tree can be drawn into the air flow through the air conditioner unit 100. The "cotton" can foul the cooling fins. In such an environment, a cover might include a second air permeable panel 210 with fine enough mesh to catch the "cotton" from a cottonwood tree. Of course, the cover must be designed to provide with sufficient sized openings to allow enough air to be drawn through the heat rejection unit so that the refrigerant can be sufficiently cooled.

Figure 10:
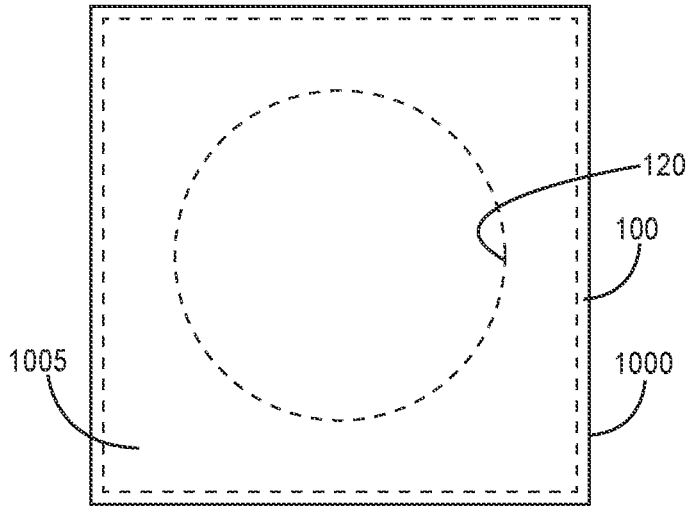
FIG. 10 is a view of a winter cover that can be used in colder climates where snow occurs during part of the year, according to an example embodiment.

FIG. 10 is a view of a winter cover 1000 that can be used in colder climates where snow occurs during part of the year, according to an example embodiment. The winter cover will prevent or substantially prevent snow from entering the exhaust port 120 of the air conditioner unit 100. The air conditioner unit 100 and the exhaust port 120 are shown in phantom in FIG. 10 as they are beneath the cover 1000. The cover 1000 includes a substantially thick and durable panel 1005 that can withstand a snow load across the exhaust port 120 opening in an air conditioner. 100. The cover 1000 can attach to the air conditioner or the corners of the air conditioner so that it will remain in place in the event of windstorms, blizzards, and the like. The cover 1000 can be placed over the horizontal panel 105 of the air conditioner without one of the covers, or can be placed directly over a cover, such as covers 500, 900 or 200

While embodiments of the present disclosure are described with respect to examples of conventional air conditioner units, a person skilled in the art will readily appreciate that the covers described herein can be adapted to fit air conditioner units of a variety of sizes, shapes, and configurations and to achieve different fits. Accordingly, the description of any specific covers and/or air conditioners in the present disclosure shall not be limiting.

Other embodiments of the present disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form various embodiments. Thus, it is intended that the scope of at least some of the present disclosure should not be limited by the particular disclosed embodiments described above.

Thus, the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

The foregoing description of various preferred embodiments of the disclosure have been presented for purposes of illustration and description. It is not intended to be exhaustive or to limit the disclosure to the precise embodiments, and obviously many modifications and variations are possible in light of the above teaching. The example embodiments, as described above, were chosen and described in order to best explain the principles of the disclosure and its practical application to thereby enable others skilled in the art to best utilize the disclosure in various embodiments and with various modifications as are suited to the particular use contemplated. It is intended that the scope of the disclosure be defined by the claims appended hereto Various examples have been described. These and other examples are within the scope of the following claims.

What is claimed is:

1. A fabric cover sized and shaped to cover an air conditioning unit, comprising:

a first fabric panel configured to provide a horizontal top panel of the fabric cover and to cover an exhaust port of the air conditioning unit, wherein the first fabric panel defines an exhaust opening greater than or equal to a size of the exhaust port of the air conditioning unit;

a second fabric panel extending from the first fabric panel and configured to provide a vertical side panel and to cover vented air intakes of the air conditioning unit, the second fabric panel connected to the first fabric panel, wherein the second fabric panel includes two or more sections connected by one or more seams therebetween, wherein the first fabric panel is made of a first air permeable fabric material and the second fabric panel is made of a second air permeable fabric material; and a structure configured to maintain a shape of the exhaust opening in the first fabric panel.

2. The fabric cover of claim 1, wherein the first material, the second material, or both are a stretchable fabric.

3. The fabric cover of claim 2, wherein the second air permeable fabric material is selected from a list consisting of a power mesh fabric, a cabaret stretch mesh fabric, and a honeycomb mesh fabric.

4. The fabric cover of claim 2, wherein the first air permeable fabric material is a substantially non-stretch fabric material selected from a list consisting of a canvas fabric and a nylon fabric.

5. The fabric cover of claim 1, wherein the first air permeable fabric material can maintain an air flow of about 1300 $ft^3$ $min^{-1}$.

6. The fabric cover of claim 1, wherein an average pore size of the first air permeable fabric material is greater than an average pore size of the second air permeable fabric material and wherein a ratio of the average pore size of the first air permeable fabric material to the average pore size of the second air permeable fabric material is about 100:1.

7. The fabric cover of claim 1, wherein an average pore size of the first air permeable fabric material is about 1 cm.

8. The fabric cover of claim 1, wherein an average pore size of the second air permeable fabric material is about 1 mm.

9. The fabric cover of claim 1, wherein the one or more seams comprise an elastic material.

10. The fabric cover of claim 1, wherein the structure is a hoop.

11. The fabric cover of claim 1, further comprising an adjustable fastener provided in a bottom portion of the second air permeable fabric panel for securing the cover to a base of the air conditioning unit.

12. The fabric cover of claim 11, wherein the adjustable fastener comprises elastic material.

13. The fabric cover of claim 11, wherein the adjustable fastener is a drawstring.

14. The fabric cover of claim 1, wherein the first fabric panel comprises means for attaching the fabric cover to a top panel of the air conditioning unit.

15. The fabric cover of claim 1, wherein the first fabric panel comprises straps placed at corners of the first fabric panel designed and dimensioned to attach the first fabric panel to a top panel of the air conditioning unit.

16. A fabric cover sized and shaped to cover an air conditioning unit, comprising:

a first fabric panel configured to provide a horizontal top panel of the fabric cover; and a second fabric panel extending from the first fabric panel and configured to provide a vertical side panel, the second fabric panel connected to the first fabric panel, wherein the second fabric panel includes two or more sections connected by one or more seams therebetween, wherein the first fabric panel is made of a first air permeable fabric material and the second fabric panel is made of a second air permeable fabric material, wherein corners of the fabric cover which correspond to corners of a top panel of the air conditioning unit are formed of a canvas fabric and a nylon fabric.

* * * * *